United States Patent [19]

Deschatrettes et al.

[11] Patent Number: 4,468,893

[45] Date of Patent: Sep. 4, 1984

[54] MACHINE FOR MACHINING AND IN PARTICULAR GRINDING CYLINDRICAL SURFACES

[75] Inventors: Gérard Deschatrettes, Guecellard; René Tirel, Pont de Gennes, both of France

[73] Assignee: Glaenzer Spicer, Poissy, France

[21] Appl. No.: 300,981

[22] Filed: Sep. 9, 1981

[30] Foreign Application Priority Data

Sep. 29, 1980 [FR] France ..... 80 20805

[51] Int. Cl.[3] ..... B24B 5/04

[52] U.S. Cl. ..... 51/105 R; 51/108 R; 51/215 CP; 51/237 T; 409/165; 409/221; 82/2.5; 414/737; 414/744 C

[58] Field of Search ..... 51/105 R, 105 SP, 105 LG, 51/106 R, 106 LG, 108 R, 145 R, 145 T, 215 R, 215 CP, 215 H, 215 UE, 217 T, 236, 237 R, 237 T, 290, 291; 82/2.5, 2.7; 279/5, 46, 51; 409/164, 165, 221; 414/735, 737, 744 C, 783; 269/48.1

[56] References Cited

U.S. PATENT DOCUMENTS

| | | | |
|---|---|---|---|
| 428,195 | 5/1890 | Wood et al. | 51/105 R |
| 2,278,651 | 4/1942 | Eberhardt | 279/5 |
| 3,340,755 | 9/1967 | Oman | 82/2.5 |
| 4,008,900 | 2/1977 | Khoshaba | 409/221 X |
| 4,030,252 | 6/1977 | Price | 51/215 CP X |
| 4,042,122 | 8/1977 | Espy et al. | 414/783 X |
| 4,201,394 | 5/1980 | Morawski | 269/48.1 X |
| 4,209,181 | 6/1980 | Morawski | 279/5 |

FOREIGN PATENT DOCUMENTS 792811 4/1958 United Kingdom .

*Primary Examiner*—Robert P. Olszewski

*Attorney, Agent, or Firm*—Wenderoth, Lind & Ponack

[57] ABSTRACT

The machine comprises a support surface for a reference surface on the body of the workpiece, and a device for fixing the body on the support surface and releasing the body. A withdrawable device is provided for angularly positioning the blank on the support surface. The device comprises a V-shaped recess facing the support surface. The machine permits a center-less grinding of cylindrical surfaces in overhanging relation and in particular trunnions of tripods for homokinetic joints.

5 Claims, 8 Drawing Figures

MACHINE FOR MACHINING AND IN PARTICULAR GRINDING CYLINDRICAL SURFACES

DESCRIPTION

BACKGROUND OF THE INVENTION

The present invention relates to a machine for in particular grinding cylindrical surfaces which project from a body, and in particular trunnions of tripod elements for homokinetic joints, this machine being also applicable to other operations for machining cylindrical surfaces on workpieces comprising a body to which blanks of said surfaces are connected.

It is conventional to effect a center-less grinding of many workpieces, for example completely cylindrical workpieces such as the races of ball bearings, shafts, etc. For this purpose, the cylindrical surface to be rectified itself acts as a rotating support surface bearing against a supporting bar during the grinding operation.

On the other hand, this technique cannot be employed when the surface to be ground is too short to act as a support and is in overhanging relation on a body which does not have another coaxial cylindrical surface which could perform this function.

This is in particular the case of slidable tripod elements for homokinetic joints. Thus, since the introduction of tripod homokinetic joints in 1960 up to the present time, more than 100 millions of tripod elements have been ground between points by means of six centers previously machined in each blank of the tripod by means of a special machine, namely a center at the end of each trunnion and a center in confronting relation to the centers at the end of each trunnion in the hub or body.

For the purpose of permitting a center-less grinding, and more generally machining, of such workpieces, so as to economize the machining of the center, a machine has been proposed (patent G.B. Pat. No. 792,811) comprising a surface for supporting a reference surface for the body of the workpiece, and a device for fixing said body on said surface and releasing said body. However, in this known arrangement, it is difficult to precisely and rapidly position each workpiece to be machined on the support surface of the machine.

SUMMARY OF THE INVENTION

An object of the invention is to improve the automatization of the machine and the precision and rapidity of its operation.

The invention therefore provides a machine for machining or grinding of the aforementioned type, which comprises a withdrawable means for angularly positioning the blank on said support surface.

In a particularly simple and effective embodiment, the positioning means comprises a V-shaped recess facing said support surface and adapted to cooperate with the blank to be machined.

When the body carries a plurality with blanks of cylindrical surfaces arranged angularly therearound, preferably, the angular positioning means comprises the same number of V-shaped recesses located in corresponding angular positions and is connected to an indexing device according to the corresponding angles.

In order to simplify the setting up of the machine, it is advantageous to arrange that the angular positioning means be connected to a withdrawable support by a flexible connection which allows a relative angular deviation. In order to facilitate the loading of the successive workpieces on the support surface of the machine, the angular positioning means may be associated with workpiece handling means.

Another object of the invention is to provide a grinding unit comprising a plurality of machines such as that defined hereinbefore, in each of which machines the support surface is connected to a rotary spindle whose axis coincides with the axis of the cylindrical surface to be ground, the axes of all the spindles being arranged around the working position of a rotary grinding wheel which is common to all the workpieces.

BRIEF DESCRIPTION OF THE DRAWINGS

Further features and advantages of the invention will be apparent from the ensuing description which is given merely by way of example with reference to the accompanying drawings, in which.

DETAILED DESCRIPTION OF THE INVENTION

Figure 1:
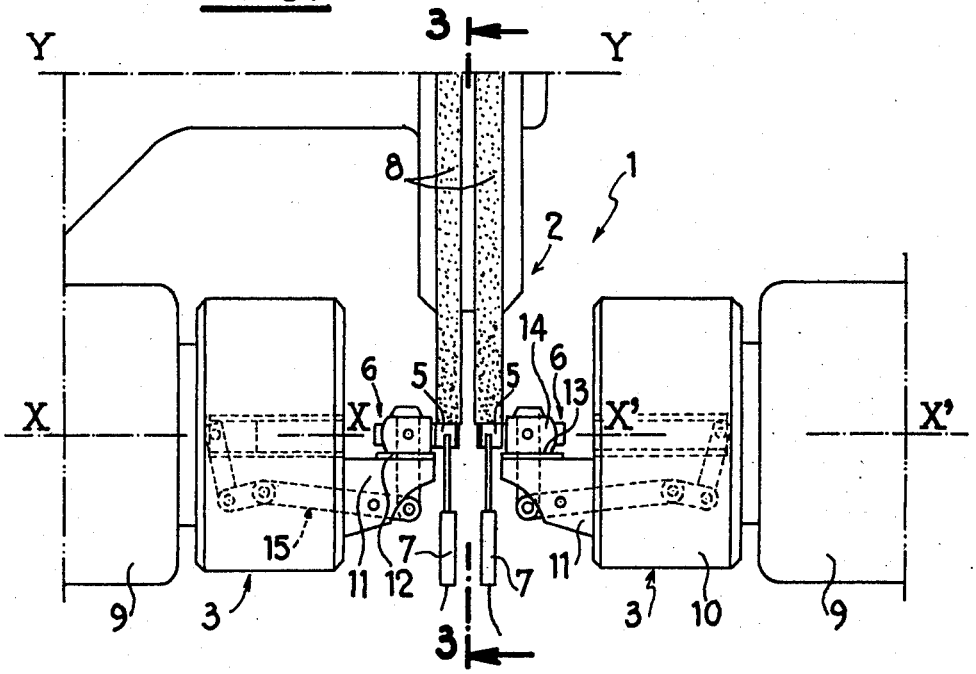
FIG. 1 is a partial diagrammatic plan view of a double machine according to the invention in the course of operation thereof.
Figure 2:
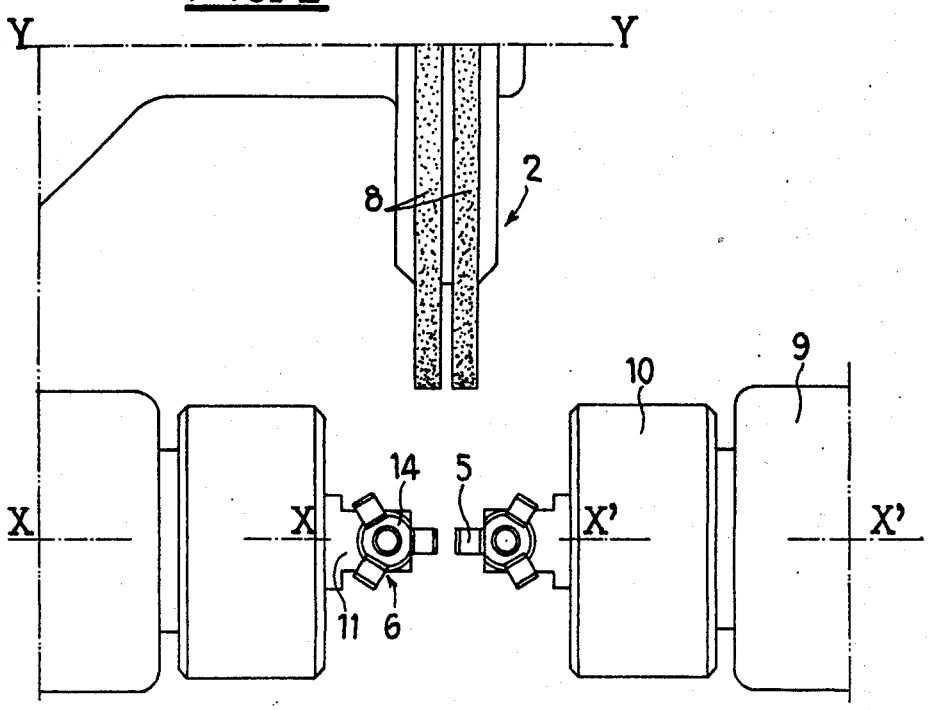
FIG. 2 is a similar view at another stage of the cycle of operation of the machine.

The machine shown in FIGS. 1 to 4 comprises a double rotary grinding wheel 2 (not shown in FIG. 4), two rotary spindles 3 whose axes are parallel and horizontal X—X, X'—X' disposed in facing relation to each other, and two angular positioning devices 4 (not shown in FIGS. 1 and 2). It is adapted to simultaneously machine in pairs the trunnions 5 on two tripod blanks 6 for homokinetic joints.

The axis Y—Y of the grinding wheel 2 is parallel to the axes X—X and X'-X' and may be displaced at a rapid speed of approach toward the latter and be rapidly moved away therefrom at the end of grinding under the control of two electric gauges 7 which bear against the two considered trunnions. As illustrated, the grinding wheel 2 comprises two parallel abrasive discs 8. Each of the axes X—X and X'—X' is individually movable at a slow speed toward the axis Y—Y during grinding and at a high speed toward its initial position at the end of grinding.

Figure 5:
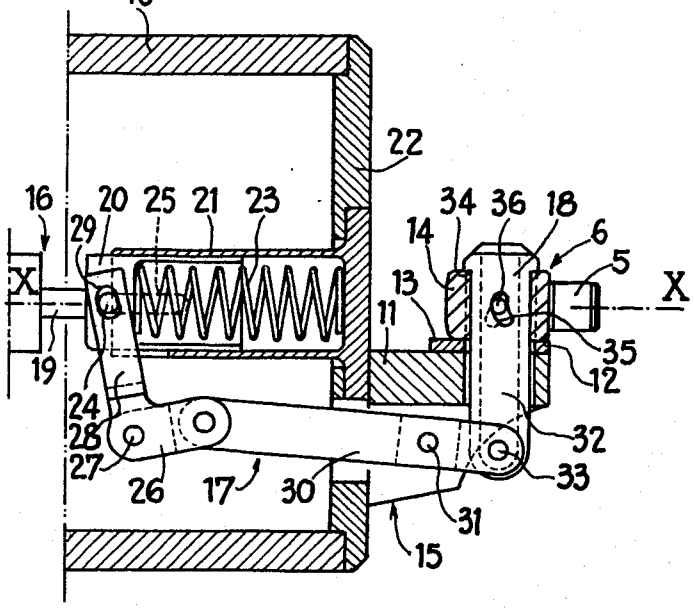
FIG. 5 is a longitudinal sectional view to an enlarged scale of a fixing device of the machine.

Each spindle 3 comprises a unit 9 for driving in rotation a plate 10 extended by a bracket 11. The latter carries a support plate 12 which defines a support surface 13 for the hub 14 of a tripod blank 6. Incorporated in the plate 10 and the bracket 11 is a device 15 for fixing the hub 14 on the surface 13 and which is shown in FIG. 5.

The fixing device 15 comprises a single acting cylinder device 16 having an axis X—X and connected by a linkage 17 to an expansible clamp 18.

The piston rod 19 of the cylinder device 16 carries an end head portion 20 which is guided in a cylinder 21 projecting into the front wall 22 of the plate 10. The head portion 20 is biased by a spring 23 in the direction opposed to the wall 22 and carries two diametrally opposed pins 24 which are guided in longitudinally extending recesses 25 in the cylinder 21.

The linkage 17 comprises two parallel L-shaped levers 26 which are mounted by the corner thereof to pivot about a common pin 27 rigid with the plate 10. A branch 28 of each of these levers includes a slot 29 receiving a pin 24, and the other branch is articulated adjacent the end thereof to a plate lever 30 which extends through the wall 22 and pivots about a pin 31 parallel to the pin 27 and fixed in the bracket 11.

The clamp 18 comprises two parallel connecting rods 32 which extend through the bracket 11 and the plate 12, one end of which is articulated by a common pin 33, which is parallel to the pin 31, to the free end of the lever 30. The other end of the connecting rods includes a shoulder 34 which faces the plate 12 and an oblique slot 35. The two slots 35 cross each other and have extending therethrough a pin 36 which is parallel to the pin 33 and is rigid with the bracket 11.

At rest, as shown in FIG. 5, the adjacent branches of the levers 26 and 30 make an obtuse angle and the pin 33 is in the lower position thereof. Consequently, the pin 36 is near to the upper end of the slots 35 and the upper ends of the connecting rods 32 are maintained radially separated. The clamp 18 is consequently in both the lower position and in the expanded state. Supplying fluid to the cylinder device 16 renders the angle of the levers 26 and 30 more upright in the manner of a toggle, which raises the clamp 18 and simultaneously retracts it radially by displacement of the pin 36 toward the lower end of the slots 35.

Figure 3:
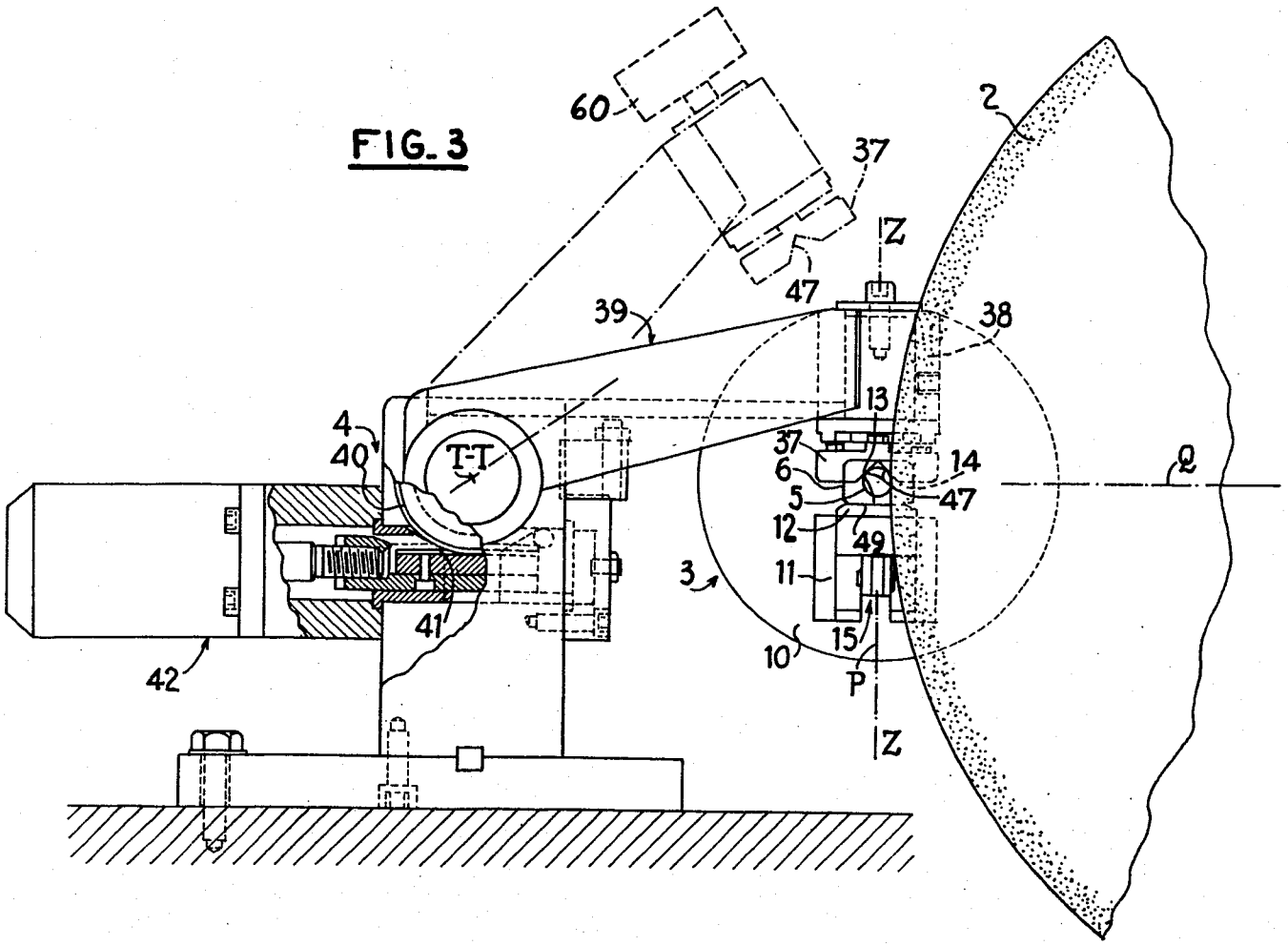
FIG. 3 is a sectional view taken on line 3—3 of FIG. 1 showing the positioning of a tripod.
Figure 4:
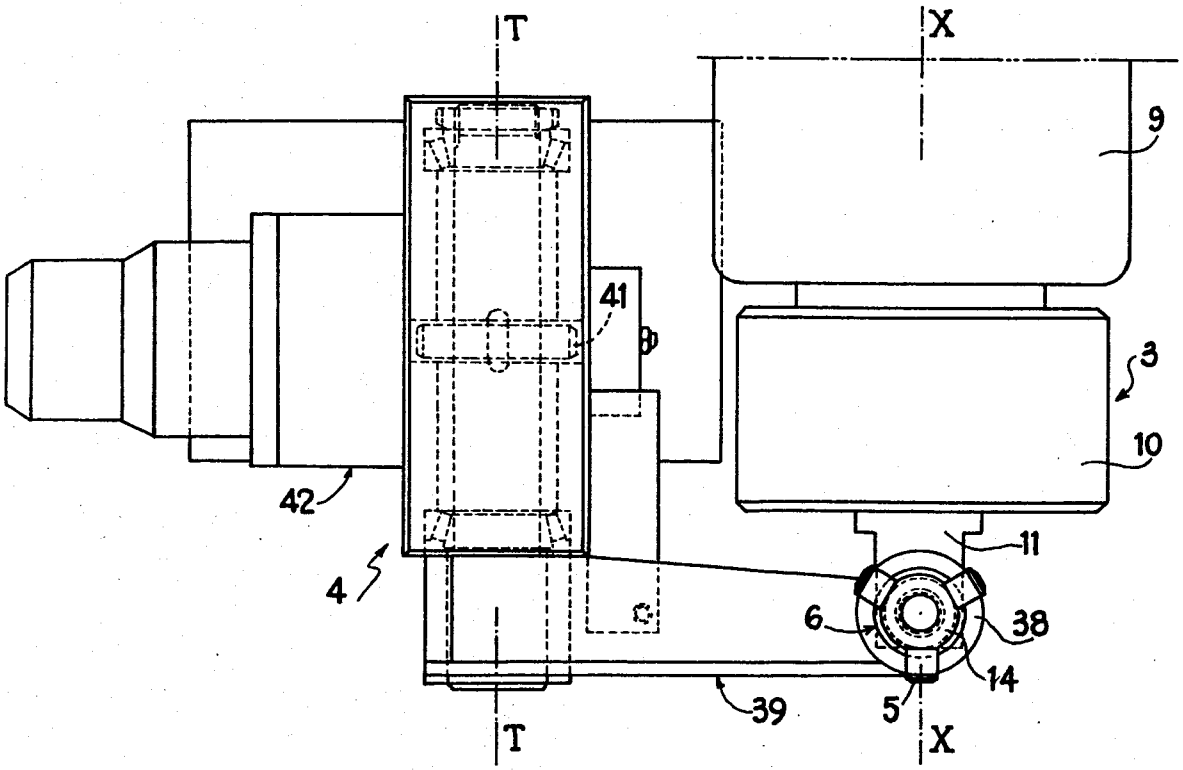
FIG. 4 is a partial plan view corresponding to FIG. 3.

An angular positioning device 4 is shown in FIGS. 3 and 4. It comprises an orienter 37 of axis Z—Z perpendicular to the support surface 13 in its active position shown in full lines. The orienter 37 is rotatively mounted on a support 38 in which there are provided, on one hand, an electromagnet (not shown) and, on the other hand, indexing means for rotation in steps of 120°, for example pinion 60 connected to orienter 37 and a rack 61 engageable with pinion 60 and operated, e.g. by a piston-cylinder unit 62. The support 38 is fixed to the end of an arm 39 the other end of which may pivot about a horizontal fixed pin T—T which is parallel to and coplanar with the axes X—X and Y—Y, under the action of a rack-and-pinion system 41, 40 actuated by a cylinder device 42.

Figure 6:
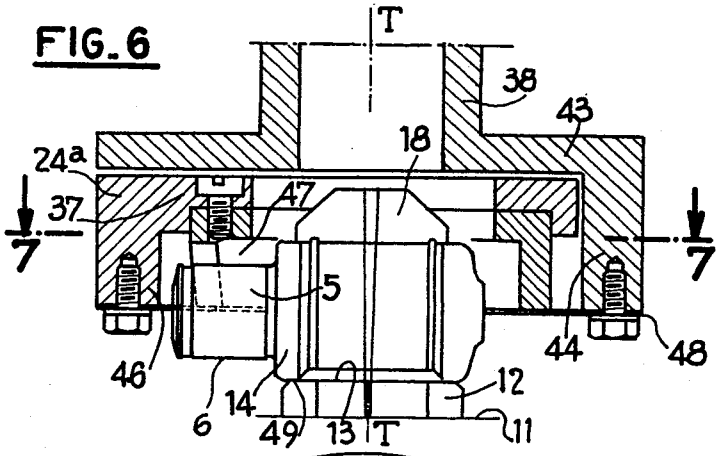
FIG. 6 is a longitudinal sectional view, also to an enlarged scale, of an angular positioning means of the machine.
Figure 7:
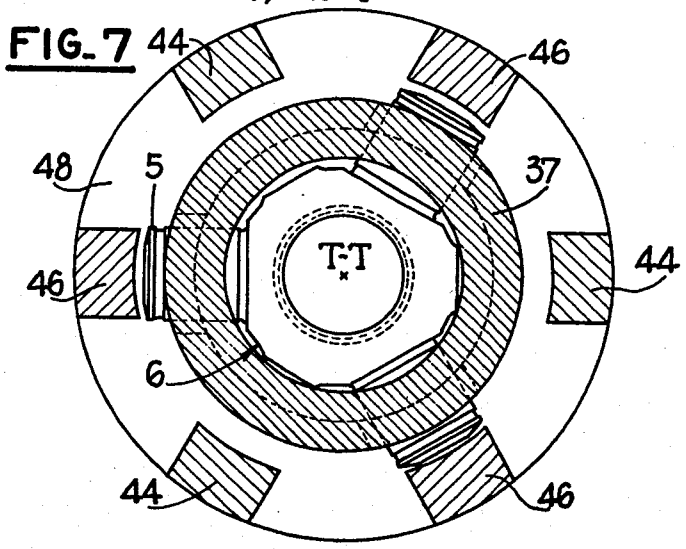
FIG. 7 is a sectional view taken on line 7—7 of FIG. 6.

As shown in more detail in FIGS. 6 and 7, the support 38 terminates in an annular plate 43 from which extend three peripheral protecting portions 44 which are angularly spaced 120° apart. In the cavity defined by these projecting portions there is inserted with axial and radial clearance the orienter 37 which is constituted by a ring from the periphery of which extend radially outwardly and axially three arms 46 spaced angularly 120° apart and interposed between the projecting portions 44. The lower surface of the ring 37 includes three radially extending recesses 47 angularly spaced 120° apart and having an inverted V-shaped cross section. The plane of symmetry of each V intersects the axis Z—Z of the support 38.

The ring 37 (shown as being made from two parts screwed together for facilitating the operations) is connected to the plate 43 by an elastically yieldable annular washer 48 which is fixed at three points to the projecting portions 44 and at three other points to the arms 46.

Assuming that it is desired to grind the trunnions of two tripod element blanks 6, the latter are previously machined in a conventional manner by employing an end surface 49 of their hub 14 as a reference surface, and then subjected to a heat treatment which may have deformed the blank and in particular the trunnions 5. Initially, the axes X—X and X'—X' are coincident and the arms 39 are raised and withdrawn as shown in dot-dash lines in FIG. 3. The support surfaces 13 are horizontal, the clamps 18 are in their upper and withdrawn position, and the grinding wheel 2 is in its withdrawn position shown in FIG. 2.

The electromagnet of each device 4 is energized, and a blank 6 is placed in each ring 37 so that its trunnions 5 are received in the recesses 47 and the reference surfaces 49 are is facing downwardly.

Under the action of the cylinder devices 42, the arms 39 are lowered and the surface 49 of each blank is applied against the associated surface 13, the hub 14 being fitted on the clamps 18.

When adjusting or setting the machine, the position of the axis T—T of each arm 39 is very carefully adjusted so as to ensure (FIG. 3) the perfect coincidence of the axis Z—Z, and consequently of the axis of the trunnion 5 to be ground, with the vertical plane T containing the axis of rotation X—X of the spindles 3. Further, the coincidence of the axis of the trunnion 5 with the horizontal plane W containing the axis X—X of rotation of the spindle 3 is achieved by the precise positioning of the support plane 13 carried by the bracket 11 with respect to the axis X—X. Further, the flexible washer 48 compensates for any deviation from parallelism between the orienter support 38 and the reference support plane or surface 13, which ensures a complete support on the generatrices of the three trunnions 5 of each blank 6 of the six positioning surfaces defined by the three V-shaped recesses 47 and, consequently, the very precise angular positioning of each blank. By these positioning means and owing to the fact that the prior machining of the blanks was carried out by using the same surface 49 for their positioning and their fixing, in practice, there is achieved a centering of these blanks to within less than 0.05 mm with respect to the axis of rotation X—X of the spindles 3, notwithstanding the distorsion undergone by the blank between the initial turning or forming operation and the grinding operation owing to the inevitable deformation resulting from the heat treatement.

Thereafter, the cylinder devices 16 are connected to the discharge, which expands and lowers the clamps 18 and locks the hubs 14 on their support surfaces 13 in their previously defined position. The electromagnets of the arms 39 are then de-energized, and these arms are raised so as to leave a free passage for the grinding wheel 2. The latter is fed at high speed in translation, the spindles 3 are driven in rotation, and the grinding wheel grinds the first two trunnions with a slow feeding speed of the two spindles 3 until the gauge 7 associated with each spindle stops this feed. When the two spindles are stopped, the spindles and the grinding wheel effect a rapid reverse movement to their respective initial positions.

The grinding must, on one hand, re-create the correct geometry of the trunnions 5, and, on the other hand, completely eliminate the burning effect of the heat treatment, i.e. the blackish color. Owing to the precise positioning explained hereinbefore, these two conditions are fulfilled by removing a minimum of material when grinding; consequently, the major part of the surface layer of small depth hardened by plunging in a cooling fluid after cementation or carbonitriding is preserved.

Thereafter, with respect to each of the other two pairs of trunnions, the arms 39 are again lowered and are applied by their V-shaped recesses 47 on the trunnions 5. The clamps 18 are withdrawn and raised, and, by pivoting through 120° about the axes Z—Z, the orienters 37 displace the tripod element blanks 6 to their new positions and position them with the same precision as before, the points of angular setting being determined by a suitable clearance-free indexing mechanism (not shown). Then the clamps 18 again lock the blanks against the support surfaces 13, the arms 39 swinging about the axis T—T and leaving free the working space around the blanks, and the grinding wheel effects the grinding operation and then withdraws at the same time as the spindle 3 to the position of rest.

Lastly, each spindle 3 is turned in such manner that its surface 13 faces downwardly and the clamps 18 are withdrawn, which causes the ground tripod elements to drop away for discharge. During the last grinding operation, new blanks 6 are placed in position in the orienters 37.

The machine 1 consequently permits the rapid and precise grinding of the trunnions of one or two tripod elements with no necessity to previously machine centers in the tripod element. The loading, the indexing and the discharge of the tripod element are very easy to achieve and the whole of the cycle may be automatized.

The same principle of positioning and support also permits a simultaneous grinding of any number of trunnions which are either maintained on each side of a simple grinding wheel or a double grinding wheel as shown in FIG. 1, or maintained on a single side of this grinding wheel. For this purpose, as shown in FIG. 8, the axes of rotation of the spindles 3 are arranged about the working position of the single or double common grinding wheel 2.

In this case, as before, the rapid return and rapid approach are effected by the grinding wheel. FIG. 8 shows respectively in full lines and dotted lines the active position of the grinding wheel and the withdrawn position it occupies during the loading, the positioning and the discharge of the tripod elements 6. The slow working feed or advance during the grinding operation is, hereagain, achieved individually on each workpiece-carrying spindle 3, as is of course achieved the continuous control by means of an electrogauge which electrically detects the end of the operation for each spindle 3 and, therefore, for each trunnion in the course of machining and then stops the slow feeding of this spindle. On the other hand, the rapid approach and rapid return control for the grinding wheel is single irrespective of the number of workpiece-carrying spindles 3 and the same may be true of the loading, locking, unlocking and discharging controls for the tripod element.

Figure 8:
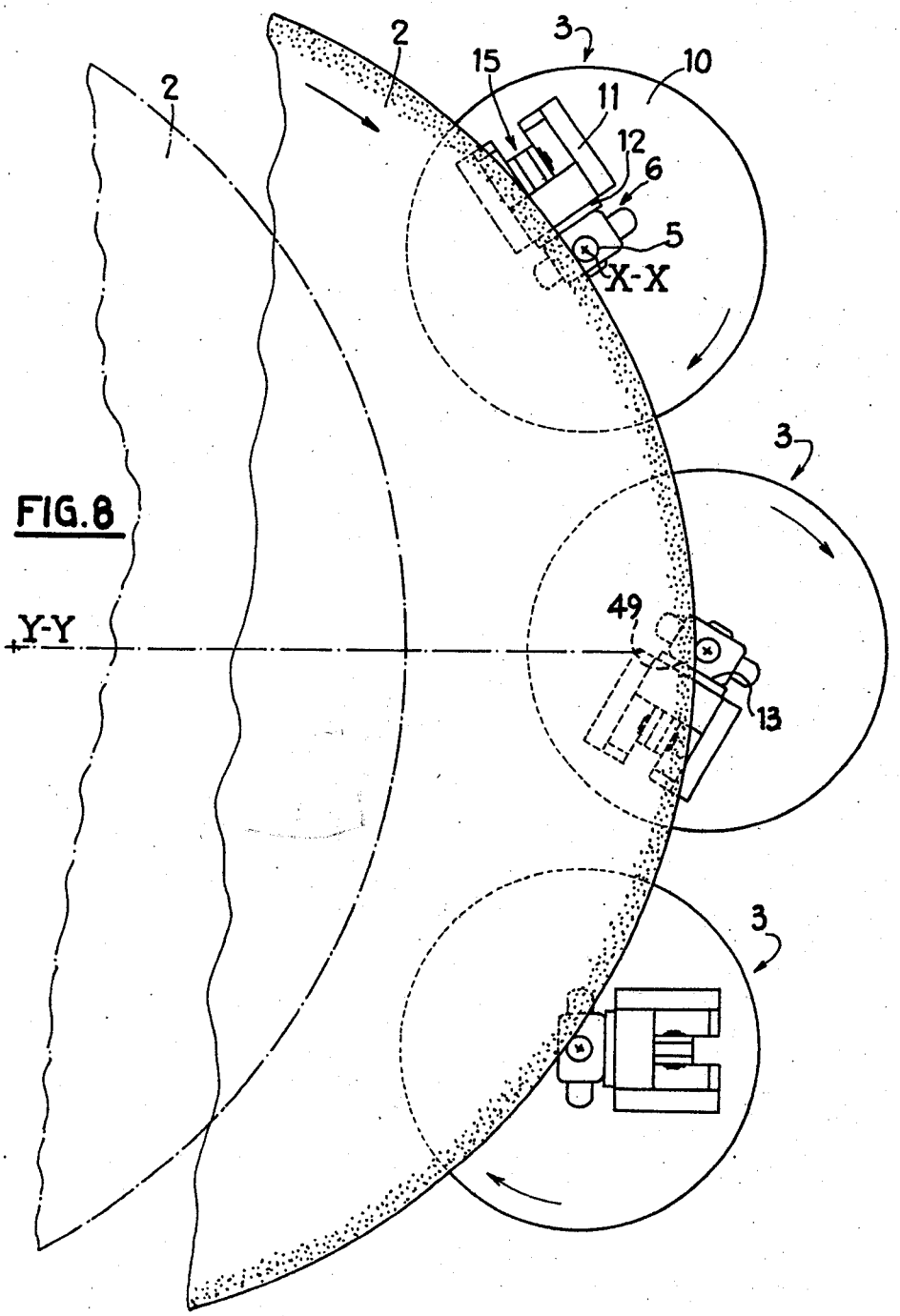
FIG. 8 is a diagrammatic end elevational view of a unit for effecting simultaneous grinding operations according to the invention.

The unit shown in FIG. 8 thus permits carrying out a center-less grinding operation of high precision and high production rate.

It will be clear that the invention may be employed for workpieces other than tripod elements, such as the spiders of universal joints or shafts of various shapes, and for other machining operations by fixed or movable tools. It will be understood that, in accordance with the shape of the considered workpieces, and in particular the number of cylindrical surfaces they include, there will be possibly provided additional axial positioning means for these surfaces or, on the contrary, means for compensating for hyperstaticity.

Further, various modifications may be envisaged as concerns the manner in which the relative movements of the grinding wheel and spindles are effected. For example, each spindle may return individually to the initial position thereof at the end of the grinding of the trunnion it carries and, if the machine is employed for grinding a single trunnion at a time, it may be arranged that it is the grinding wheel which alone effects the slow and rapid displacements.

Having now described our invention what we claim as new and desire to secure by Letters Patent is:

1. A machine for machining, such as grinding, a plurality of cylindrical surfaces on a workpiece which comprises a body which has an axis and a machined reference surface perpendicular to said axis and to which body unmachined blanks of said cylindrical surfaces are connected, said blanks extending radially from said axis in a plane parallel to said reference surface and being angularly equally spaced apart, said machine comprising a planar support surface for supporting said reference surface, a device for selectively fixing said body on said support surface and releasing said body from said support surface, and a withdrawable means movable between a withdrawn position and an operative position for angularly positioning said blanks about said axis relative to said support surface, said withdrawable means comprising a support, an element in a plane perpendicular to said axis and defining inverted V-shaped recesses in a number and in angular positions corresponding to the number and angular positions of said blanks, the recesses being divergent relative to said support surface, an indexing device for rotating said element about said axis in angular increments corresponding to the angular spacing between said V-shaped recesses for bringing each of said blanks in turn to a position for machining said cylindrical surface on each blank, and elastically yieldable means for allowing said element a slight angular deviation from a plane perpendicular to said axis in order to accommodate any slight lack of parallelism between said element and said support surface, said elastically yieldable means comprising an elastically yieldable washer connected at angularly spaced apart first points to said support and connnected at second points interposed between said first points to said elements.

2. A machine according to claim 1, for machining by means of a fixed tool and in particular for grinding, wherein said support surface is connected to a rotary spindle which has an axis of rotation coinciding with an axis of the cylindrical surface of that blank which is in the machining position thereof.

3. A machine according to claim 1, for machining workpieces whose body comprises a hollow hub, wherein said fixing device comprises an inner clamp for the hub and means for radially contracting and expanding said clamp.

4. A machine according to claim 3, wherein said clamp comprises a shoulder which faces said support surface and is combined with clamp raising and lowering means.

5. A machine according to claim 1, wherein said withdrawable angular positioning means is associated with means for holding the workpiece in position relative to the withdrawable positioning means.

* * * * *